United States Patent [19]

Förster et al.

[11] 4,321,964

[45] Mar. 30, 1982

[54] RECUPERATIVE HEAT EXCHANGER OF CERAMIC MATERIAL

[75] Inventors: Siegfried Förster, Alsdorf; Axel Krauth; Horst R. Maier, both of Bavaria; Hans J. Pohlmann, Marktredwitz, all of Fed. Rep. of Germany

[73] Assignee: Kernforschungsanlage Julich Gesellschaft mit Berschrankter Haftung, Rosenthal Technik AG, Fed. Rep. of Germany

[21] Appl. No.: 44,761

[22] Filed: Jun. 1, 1979

Related U.S. Application Data

[63] Continuation-in-part of Ser. No. 9,866, Feb. 7, 1979, abandoned.

[30] Foreign Application Priority Data

Feb. 11, 1978 [DE] Fed. Rep. of Germany ..... 2805817
Feb. 2, 1979 [GB] United Kingdom ..... 3644/79

[51] Int. Cl.[3] ..... F28D 9/02
[52] U.S. Cl. ..... 165/165
[58] Field of Search ..... 165/165, 166

[56] References Cited

U.S. PATENT DOCUMENTS 3,818,984 6/1974 Nakamura ..... 165/166
3,926,251 12/1975 Pei ..... 165/165
4,265,302 5/1981 Förster et al. ..... 165/165

FOREIGN PATENT DOCUMENTS 2269694 2/1976 France ..... 165/165
373455 5/1932 United Kingdom ..... 165/165
756327 9/1956 United Kingdom ..... 165/165
766668 1/1957 United Kingdom ..... 165/165
2005355 4/1979 United Kingdom ..... 165/165

*Primary Examiner*—Sheldon J. Richter
*Assistant Examiner*—G. Anderson
*Attorney, Agent, or Firm*—Ostrolenk, Faber, Gerb & Soffen

[57] ABSTRACT

The invention relates to a recuperative heat exchanger comprising an elongate rotationally symmetric body of ceramic material having radially outwardly extending, flow channels of slot like cross-section extending along the axis of the body. Alternate flow channels extend further toward the surface of the body and further toward the axis of the body, respectively. Inlet and outlet openings are provided for the flow channels about at the ends of the body. The invention also comprises a process for making such a heat exchanger, including extruding ceramic material through an extrusion nozzle with a free cross-section in which core bodies are shaped and positioned for generating the flow channels and inner and outer cover walls defining the flow channels. The invention further comprises the extrusion nozzle in which the process is performed.

11 Claims, 8 Drawing Figures

RECUPERATIVE HEAT EXCHANGER OF CERAMIC MATERIAL

CROSS REFERENCE TO RELATED APPLICATION

This is a continuation-in-part of Ser. No. 9,866, filed Feb. 7, 1979, now abandon.

BACKGROUND OF THE INVENTION

1. Field of the Invention

The invention relates to a recuperative heat exchanger comprised of ceramic material and including several chambers, arranged side-by-side in a row, and all having inlet and outlet openings for the material involved in the process of heat transfer, wherein adjacent chambers have a common dividing wall between them, and alternate chambers respectively transmit one or the other of the media involved in the process of heat transfer. Such a heat exchanger is shown in German patent application P No. 27 07 290.8.

2. The Prior Art

Certain known recuperative heat exchangers of ceramic material are in the form of plate heat exchangers. The plates, which are stacked one above the other, define the dividing walls between the media flowing through the chambers. Plate heat exchangers have large areas for exchanging the heat and, with respect to their weight and the volume they occupy, the efficiency of heat exchange is good. The heat exchangers are, therefore, particularly suitable for heat exchange between gaseous media in the field of gas turbines at temperatures ranging above 800° C. From a paper by Tiefenbacher: "Problems of the Heat Exchanger for Vehicular Gas Turbines", ASME Publication No. 76-GT-105, 1976, ceramic cross flow heat exchangers are known. It has, however, been found that, from an economic point of view, cross flow heat exchangers do not satisfy the requirements for the construction of vehicles.

Other known recuperative heat exchangers comprised of metal, with heat exchangers matrices of a high efficiency of heat exchangers with respect to the volume occupied and the weight, are in the form of counter flow heat exchangers (cf. British Pat. No. 655,470). In these heat exchangers folded strips of sheet metal are used. They are closed at the side areas and at the head end and are covered along the ridge of the fold in such a way that openings remain for the media involved in the process of heat exchange to flow to the matrix of the heat exchanger. An axially symmetrical heat exchanger of this type is known from German Laid-Open Patent No. 2 408 462. In this heat exchanger, the media involved in the process of heat exchange flow through the matrix of the heat exchanger in an axial direction. These heat exchangers are preferred particularly because, with the simple possibility of connecting to the pipes in which the media are flowing, any differences in pressure and temperature between the media involved in the process of heat transfer can be optimally compensated for. The manufacture of heat exchangers of ceramic material, of the same type as known metal heat exchangers, by folding thinly rolled ceramic material is, however, beset with difficulties. Large numbers of heat exchangers cannot be made in this way.

SUMMARY OF THE INVENTION

The object of the invention is to provide a recuperative heat exchanger of ceramic material, which, with respect to th volume it occupies and its weight, has a high efficiency of heat exchange, can be manufactured in a simple way and is designed so that thermal stresses can be limited. Another object is to provide a process for producing such a heat exchanger. A further object is to provide an apparatus for producing such a heat exchanger.

According to the invention, a recuperative heat exchanger comprises a ceramic body which is formed with a plurality of parallel flow channels arrayed annularly around the longitudinal axis of the body. Alternate flow channels are staggered in their radial positions and are arranged in such a way that a first group of chambers extend further toward the peripheral surface of the body and the alternate group extend further toward the axis of the body. The chambers that extend further toward the surface are referred to as the first group of chambers and the chambers that extend futher toward the axis are referred to as the second group of chambers.

It is preferred that the body of the heat exchanger be cylindrical and the channels be of slot-like shape extending in a radial direction.

It is also preferred that the distance by which slots of the first group extend towards the surface of the body beyond the ends of the slots of the second group be at least as great as the separation between adjacent slots.

To obtain large heat exchange areas per unit of occupied volume, the cross-sections of the flow channels advantageously are all a slot-like shape extending in the radial direction, so that the longer dimensions of the slot shapes are at the dividing wall between adjacent channels. The outwardly extending dimension of each slot is preferably a multiple of its width or thickness or circumferential width, e.g. at least 5 times its thickness, to obtain a large heat exchange area per unit of occupied volume.

Inlet and outlet openings are provided for the first group of chambers at the longitudinal ends of the body or at the outside surface of the body at or adjacent its ends. Inlet and outlet openings for the second group of chambers are provided at or adjacent the ends of the body toward the axis thereof or at the ends of the body.

For adaption of the ceramic body to a more restricted space for housing a heat exchanger, the formation of curved, shell-like shapes for the body are proposed. Covered, shell-like, ceramic heat exchangers can be joined together to form a hollow body.

The above described construction for a heat exchanger of ceramic material provides the same efficiency of heat exchange, with respect to the volume occupied and the weight, that had been previously attainable only with axially symmetrical counter flow heat exchangers made of folded thin strips of sheet metal. At the same time, there is a possibility of connecting the transport pipes for the media, and large differences of pressure and temperature can be optimally compensated for. Furthermore, the heat exchanger can also be simply manufactured as a compact unit. The staggered arrangement of the flow channels is helpful in this. With the closed head ends of the flow channels being aligned in the axial direction along the ceramic body, the cover walls close to the axis of rotation as well as the outer cover walls are partly broken away in order to form inlet and outlet openings for the flowing media. The ceramic heat exchanger can then be so connected to the inlet and outlet pipes for the media involved in the process of heat transfer that the two media flow through the matrix of the heat exchanger in an axial direction and are supplied and withdrawn in a radial direction, and in counter current flow directions.

In a further development of the invention, in at least some of the flow channels, staying members are provided between the dividing walls. This is advantageous particularly if the dividing walls between the flow channels are thin and must be reinforced to prevent breakage or deformation caused by large differences of pressure between the media. Thd dividing walls may also be strengthened by the cross-section of the flow channels being curved like an arch, e.g. in cross-section, or corrugated.

The heat exchangers of the invention are advantageously manufactured in a process in which the ceramic material is extruded through an extrusion nozzle that tapers in the direction of movement of the ceramic material through the nozzle. The process of extrusion is of importance for the mass production of heat exchangers.

The nozzle defines the axially symmetrical head end cross-section of the heat exchanger. Several core bodies are positioned inside the free outlet cross-section of the nozzle and are arranged at a distance from the nozzle wall in the radial direction with respect to the axis of rotation of the heat exchanger. The cross-sections and placement of the core bodies defines the cross-sections of the flow channels that are defined by the core bodies. There are two radially staggered groups of core bodies corresponding to the two groups of chambers. The first group of core bodies extend further toward the peripheral surface of the nozzle wall, and the second group of core bodies extend further toward the axis of the extruder. The core bodies may be rectangular, curved, e.g. like an arch, or corrugated. In a preferred embodiment of the invention the core bodies are arranged radially inside the free outlet cross-section of the extruder nozzle and the radial dimensions of the core bodies are a multiple of their cross-sectional dimensions.

The ceramic material emerging from the extrusion nozzle is cut into lengths and prefired if required. Afterward, inlet and outlet openings are provided for the flowable media involved in the process of heat transfer. Inlet and outlet openings are provided for the first group of flow channels at the ends of the body or at the outer surface of the body at or adjacent its ends. Inlet and outlet openings for the second group of flow channels are provided at or adjacent the ends of the body toward the axis thereof or at the ends of the body. For producing the inlets and outlets, at least some part of the cover walls of the body that cover the flow channels along the axial direction has been removed from the region of the head ends of the body. The flow channels which have been thus opened are then closed at the head ends with ceramic material. The body is subsequently fired. Preferably, the radial dimension of the core bodies, which are arrayed circumferentially inside the free outlet cross-section of the extruder nozzle, is a multiple of their tangential or circumferential dimension.

Other objects and features of the invention are explained below with reference to embodiments schematically illustrated in the drawings.

DESCRIPTION OF THE PREFERRED EMBODIMENTS

FIG. 1A to 2B show an axially symmetrical recuperative heat exchanger of ceramic material. It is in the form of a hollow cylinder that has two groups of interdigitated flow channels for two media between which heat is to be transferred. The flow channels are arranged annularly around the longitudinal axis of rotation 1 of the heat exchanger and each channel extends outwardly of the axis of the cylinder, i.e. radially. The heat exchanger is preferably connected to inlet and outlet pipes for the fluent media in such a way that the media involved in the process of heat transfer flow through the heat exchanger in counter current flows.

In order to outline the essential functional characteristics of the structure, the flow paths of the two media will be described first. The apparatus and the method by which it can be produced will then be described.

Figure 1A:
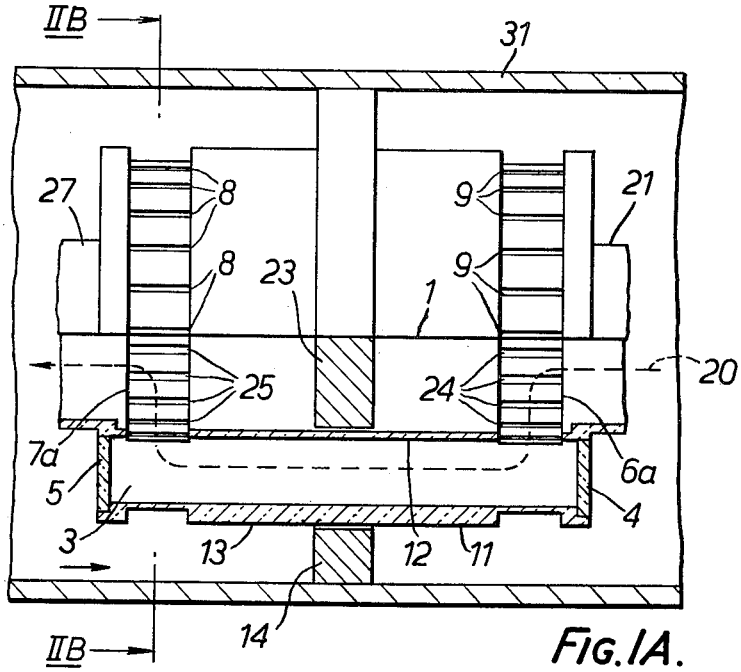
FIG. 1A is a longitudinal, partially cross-sectional view of a first embodiment of a ceramic heat exchanger in accordance with the invention, taken along the line 1A—1A of FIG. 2A.
Figure 2A:
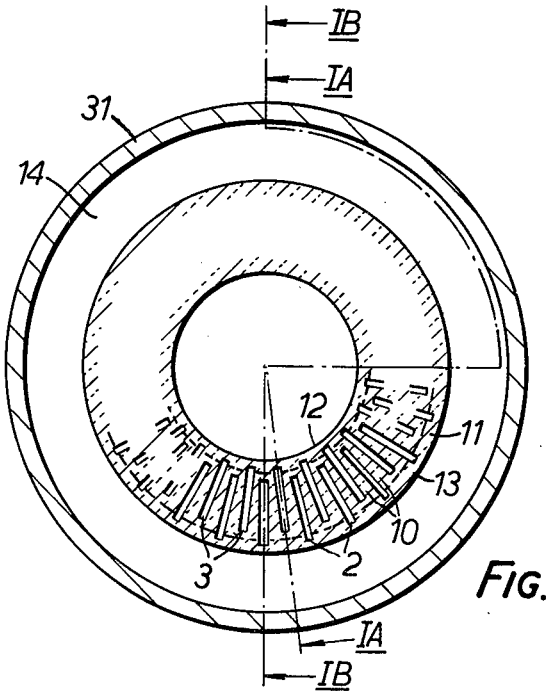
FIG. 2A is a transverse, partially cross-sectional view, taken along the line IIA—IIA of FIG. 1B.

FIG. 1A shows the flow path 20 of one fluent medium as it passes through the group 3 of longitudinally extending, slot-shaped flow channels. The flow path 20 enters at the end 21 (from a supply pipe (not shown) connected thereto) and extends along the longitudinal axis 1 of the heat exchanger. The path is diverted radially outwardly through a ring shaped inlet passage *6a*. Such diversion occurs because further passage of the medium along the axis is blocked by a baffle 23.

The fluid stream flows outwardly through an annular array of radial slots 24 that define the passage *6a*. These slots are the inside face of one end of the longitudinally extending heat exchanger slots 3. The slots 3 are separated by the closed inside edges of the other groups of slots 2. The stream 20 is preferably the stream which is to be heated. It flows axially along all of the slots 3 to their other ends. Then, on meeting the closed end wall 5, the stream is diverted radially inwardly toward the axis 1 through an annular array of the slots 25 that define a ring-shaped outlet passage *7a*. The stream then exits through the other end 27 of the heat exchanger and from there enters an outlet pipe (not shown) connected to the end 27.

Figure 1B:
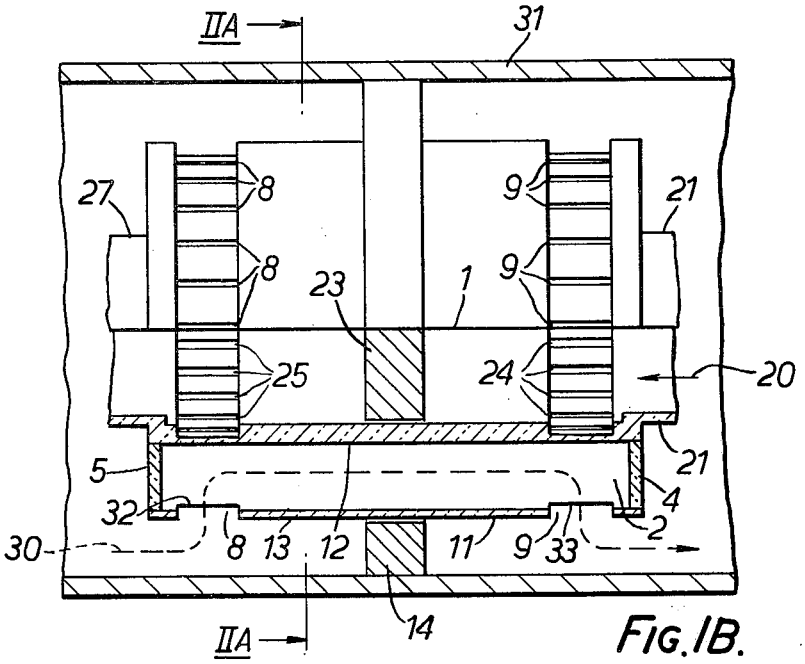
FIG. 1B is a longitudinal, partially cross-sectional view, taken along the line IB—IB of FIG. 2A.
Figure 2B:
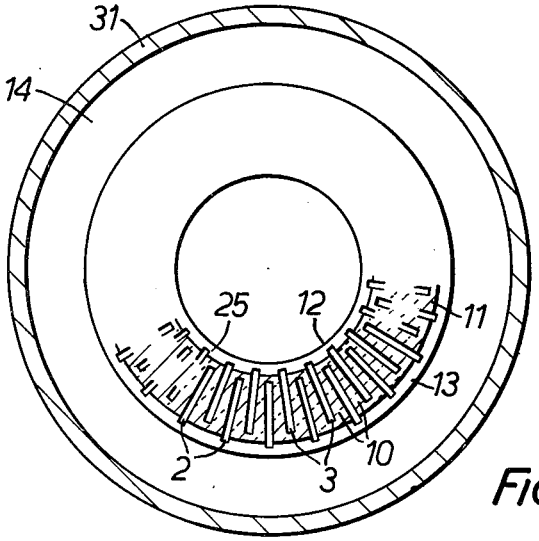
FIG. 2B is a transverse, partially cross-sectional view, along the line IIB—IIB of FIG. 1A.

FIG. 1B shows the flow path 30 of the other fluent medium, which in the preferred arrangement is the medium which is to be cooled. It is preferred that the media flow counter current to each other. Thus, the flow path 30 starts at the end 27 of the heat exchanger. This flow path passes through the group 2 of slot shaped flow channels.

The heat exchanger may be housed inside a larger diameter pipe or housing 31, part of which is shown in FIGS. 1A, 1B, 2A and 2B, through which the hot medium passes. The housing or pipe is divided by an annular baffle 14. Thus the hot stream is diverted radially inwardly through series of slots 32 that define a ring shaped opening 8. The slots 32 are analogous to the slots 24 and are separated from each other by the closed outside edges of the slots of group 3. The hot stream then flows axially, along all of the radial slots 2. On meeting the closed end wall 4, the stream is diverted radially outwardly and emerges through an annular series of slots 33 which define a ring shaped outlet passage 9. The slots 33 are analogous to the slots 25.

The heat exchanger shown in FIGS. 1A to 2B is comprised of a cylindrical annulus made of a single piece of ceramic material and having radially extending slots 2, 3 running the length of the cylinder within the body. The slots are divided into two groups 2 and 3, and slots of group 2 extending radially to nearer the outside surface of the body than the slots 3 and the slots 3 extending radially from nearer the inside surface of the body than the slots 2. The inside surface can be considered as a covering wall 12 and the outside surface as a covering wall 11. The slots of group 2 are interleaved with the slots of group 3. Each slot is separated by a wall 10 from the adjacent slots 3 on either side of it. Transfer of heat between the slots 2 and 3 occurs through the walls 10. These walls can have thicknesses as low as 0.3 mm.

The distance by which the radially outside edges of the slots 2 jut radially out past the radially outside edges of the slots 3 and the distance of which the radially inside edges of the slots 3 jut radially in past the radially inside ends of the slots 2 is in both cases preferably at least equal to the thickness of the dividing walls 10. The axial ends or heads 4 and 5 of the body are sealed to make the slots 2 and 3 gas tight.

The flow channels 2, 3 are all arranged radially with respect to the axis of the heat exchanger and have a slot-shaped cross-section, so that the radial dimension of the flow channels is large as compared with the circumferential or tangential dimension. In this embodiment, the heat exchanger has large heat exchange areas for the media involved in the process of heat exchange.

In an alternative embodiment (not shown), the outer and inner covering walls 11 and 12 can be separately attached, for example by fitting pipe sections of such dimensions that recesses for inlet and outlet openings are provided in the region of the head ends 4, 5. Closures 13, 14 jointed in gas tight manner to the covering wall 11 may be provided between outlet openings 8, 9 on the outer covering wall 11 as well as closures between the inlet and outlet openings at the inner covering wall 12.

Figure 3A:
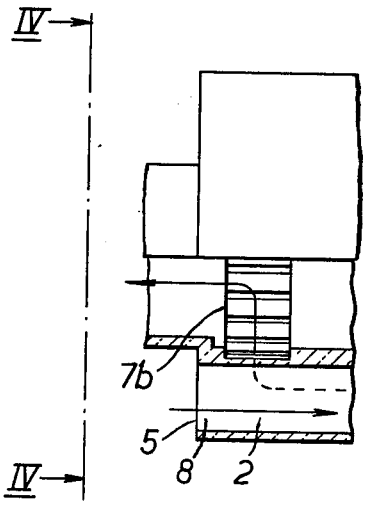
FIGS. 3A and 3B together define a composite, longitudinal, cross-sectional view of a second embodiment of a ceramic heat exchanger in accordance with the invention, taken along the lines IIIA—IIIA in FIG. 4 for FIG. 3A and along the lines IIIB—IIIB in FIG. 4 for FIG. 3B.
Figure 3B:
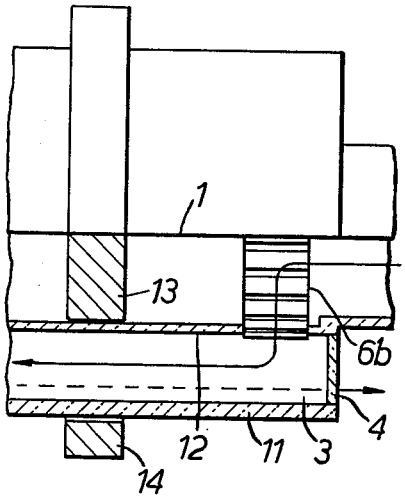
Figure 4:
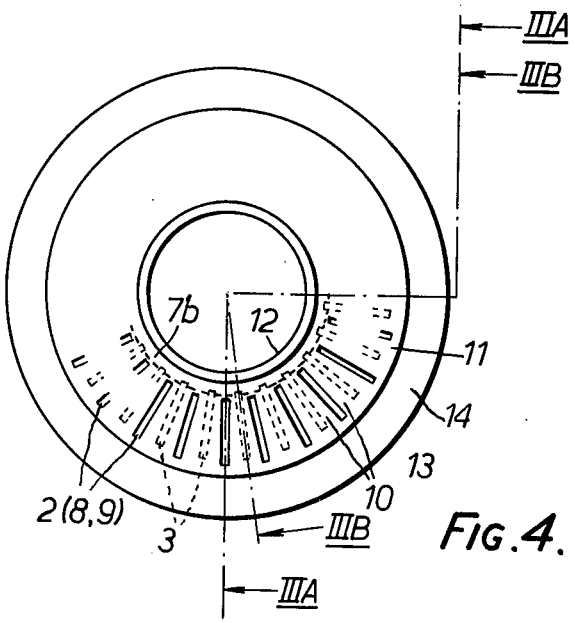
FIG. 4 is an end elevational view on the line IV—IV of FIG. 3A.

Referring now to FIGS. 3 and 4, an alternative embodiment of a heat exchanger is shown. It will be appreciated that FIGS. 3 and 4 are composite views embodying the two flow paths in a single view. Here the flow channels 2 are open at the head ends 4 and 5 (see FIG. 3A). The medium to be cooled flows to the right in FIG. 3 through the heat exchanger in the axial direction without deflection. In this example, the medium to be heated is supplied from radially inside to the matrix of the heat exchanger (see FIG. 3B) as in the embodiments of FIGS. 1 and 2. This is advantageous when the medium which is to be heated is at a higher pressure than the medium which is to be cooled. Depending on the technical application, it is, however, also possible to reverse the flow and to feed one of the media from outside radially into the matrix of the heat exchanger. In this case the flow channels 3, instead of the flow channels 2, are opened at their head ends and the flow channels 2 open radially towards the outside in the region of their head ends.

To produce a heat exchanger as shown in FIGS. 3 and 4, the inner covering wall 12 only, in the region of the head ends, is milled out to produce the ring shaped slots **6*b* and 7*b*. The flow channels 3 are filled at their head ends so as to be closed. The flow channels 2** at the head ends of the heat exchanger body are left open for the final firing.

Figure 5:
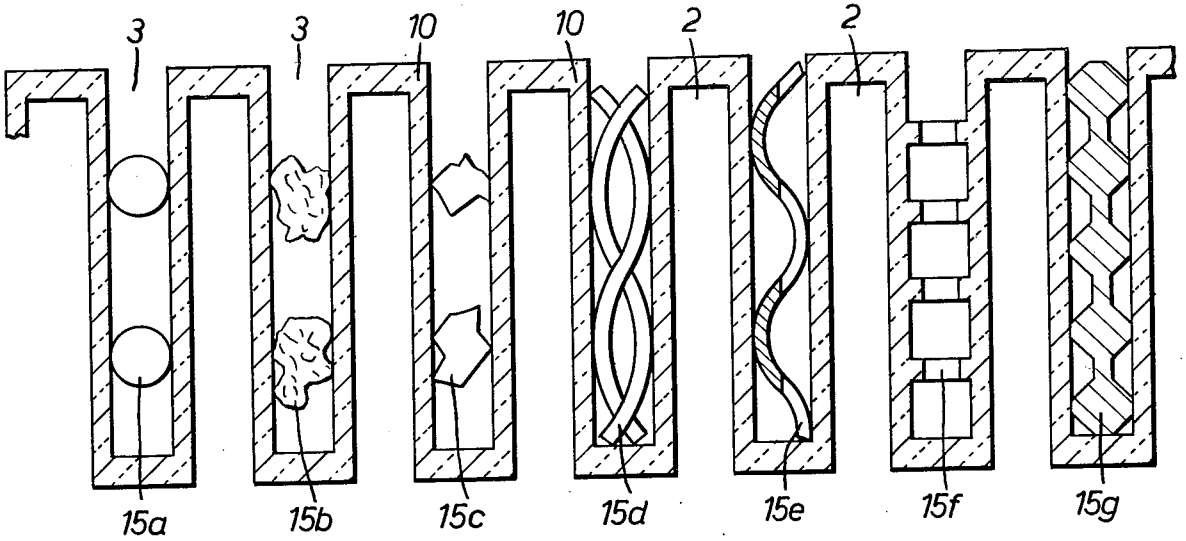
FIG. 5 is a developed view in straight rolled out detail of a hollow cylindrical heat exchanger, showing various staying members between the driving walls of the flow channels.

FIG. 5 is a much enlarged detail section, straight rolled out, of an axially symmetrical heat exchanger. Various staying members 15 are shown schematically in the flow channels 3 between the dividing walls 10. The staying members are required between the dividing walls if the two media involved in the process of heat transfer are at very different pressures. Staying members are provided in the flow channels carrying the medium which is at the lower pressure. Bodies of various shapes and various materials can be used as staying members. In FIG. 5, by way of example, spheres **15*a*, foam materials 15*b*, grains 15*c*, interlaced components 15*d* and corrugated material 15*e* are inserted into the flow channels 3. Spheres and grains can be arranged in a random distribution. The dividing walls 10 can also be supported by one or more bars 15*f* with recesses, at least in the region of the inlet and outlet openings 8, 9, through which the media involved in the process of heat transfer can flow in or out. The corrugated material 15*e* also has such recesses. Also suitable as staying members are tapes 15*g* with nub like thickenings at regular or random intervals so that many, almost point like, supporting places are formed between the dividing walls 10. Suitable materials for the staying members 15** are particularly ceramic materials.

Figure 6:
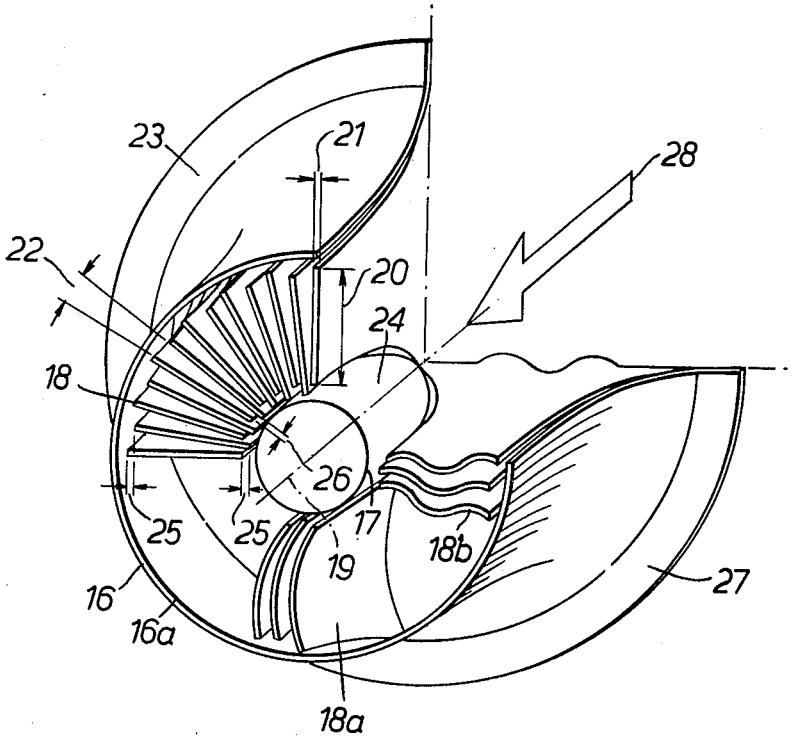
FIG. 6 is a perspective view from the outlet end of an extrusion nozzle with various core bodies for manufacturing a ceramic heat exchanger.

The ceramic heat exchangers are advantageously manufactured by means of extruders using extrusion presses for ceramic materials. FIG. 6 shows an embodiment of an extrusion nozzle for a ceramic axially symmetrical heat exchanger. The annular outlet cross-section of the extrusion nozzle with an outer diameter 16 defined by the outer wall of the nozzle and with an inner diameter 17 defined by the inner wall of the nozzle is adapted to match the outer dimensions of the head end section of the heat exchanger. The outlet cross-section for ceramic material is smaller than the inlet cross-section at the back side of the extrusion nozzle. Several core bodies 18 are arranged inside the outlet cross-section. In the embodiment of FIG. 6, they are rectangular core bodies which, with respect to the axis 19 of the hollow-cylindrical extrusion nozzle, are oriented so that their long dimensions extend radially. Their radial extensions 20 corresponds to a multiple of their circumferential or tangential extension 21. The cross-sections of the core bodies determines the cross-section of the flow channels 2, 3 of the ceramic heat exchanger. The thickness of the dividing walls 10 is determined by the angle 22 between adjacent core bodies 20. In the illustrated embodiment, the angle 22 is of such a magnitude that the thinnest part of the dividing walls is 0.3 mm thick.

The core bodies 18 are attached to the inlet end of the extrusion nozzle. They extend free-standing into the outlet cross-section of the nozzle. Every second core body juts out beyond the adjacent core bodies in the radial direction toward one of the two cover walls 23, 24, which form the outer covering surfaces of the cover walls 11, 12, respectively, of the heat exchanger. The individual core bodies overhang the adjacent core bodies by the length 25, which is equal to at least the smallest distance 26 between adjacent core bodies. The distance 26 corresponds to the wall thickness 10 in the ceramic heat exchanger.

Core bodies of various shapes can be inserted into the extrusion nozzles. In FIG. 6, in addition to rectangular core bodies 18, there are, as examples, also shown arch-like curved 18*a* and corrugated 18*b* core bodies. During extrusion of ceramic materials with such core bodies, heat exchangers with cured or corrugated cross-section flow channels are formed. These are preferably used because of the greater stiffness of their walls, as compared with the walls of the flow channels in rectangular flow channels, particularly when there are large pressure differences between the media involved in the process of heat transfer.

A heat exchanger is manufactured by pressing a suitable ceramic material through the cross-section of the extrusion nozzle shown in FIG. 6 by means of an extruder (not shown), whereby a green (unfired) strand with flow channels is formed. The green strand is cut into suitable lengths and is prefired if required. Thereafter, the cover walls are milled away at the places at which inlet and outlet openings for the flow channels are to be made. In a heat exchanger as shown in FIGS. 1 and 2, the covering wall 12 is milled away to produce a ring shaped inlet slot 6*a* and a ring shaped outlet slot 7*a* which communicate with the radial slots 3 (see FIG. 1A). The covering wall 11 is milled away to produce the ring shaped slots 8 and 9 which communicate with the radial slots 2 (see FIG. 1B). At the axial or head ends 4 and 5 the flow channels 2 and 3 are closed with ceramic material. The green heat exchanger is then fired to convert it to heat resistant ceramic form.

To produce the heat exchanger shown in FIGS. 3 and 4, the inner cover wall only, in the region of the head ends of the body, is removed. Those flow channels 3 which have thereby been opened in the radial direction are closed at their head ends 4. The other flow channels 2 at the head end of the heat exchangers are not closed before the final firing.

Heat exchangers according to the invention are suitable particularly for heat exchange between media at high temperature. The design of these heat exchangers is suitable for mass production of ceramic components by means of an extrusion process. The heat exchangers are further distinguished by the simple way in which they can be assembled, according to the principle of building blocks, to form larger heat exchanger unis for larger heat transfer performance.

Although the present invention has been described in connection with preferred embodiments thereof, many variations and modifications will now become apparent to those skilled in the art. It is preferred, therefore, that the present invention be limited not by the specific disclosure herein, but only by the appended claims.

We claim:

1. A recuperative heat exchanger, comprising:

an elongated body comprised of ceramic material and having a longitudinal axis; said body having an outer surface spaced away from said axis;

a plurality of flow channels extending through said body along the axis of said body for flow of fluid medium through said channels axially of said body; each said flow channel being slot-shaped in a cross section through the axis of said body, with a long dimension extending outwardly of said axis; said flow channels being placed next to each other, and being arranged around the axis of said body; with dividing walls separating neighboring said flow channels; adjacent said flow channels being interleaved; alternate said flow channels forming two alternating groups, a first group arranged so that its flow channels jutting past the second group of flow channels with which they alternate and extend further toward said surface of said body; the second group of flow channels extending further toward the axis of said body than the first group with which they alternate;

first inlet and outlet openings being provided for said first group of said flow channels about at the axial ends of said body, and second inlet and outlet openings for said second group of said flow channels being provided about at the axial ends of said body, whereby different media involved in heat exchange may respectively flow in said first and said second flow channels, respectively.

2. The recuperative heat exchanger of claim 1, wherein said body is annular and said flow channels are each radially extending with respect to said axis of said body.

3. The recuperative heat exchanger of either of claims 1 or 2, further comprising staying members provided in at least one of said first and said second group of flow channels and extending between said dividing walls of the said flow channels in which said staying members are provided.

4. The recuperative heat exchanger of claim 1, wherein said second inlet and said outlet openings of said second group are closer toward said axis of said body than said first inlet and said outlet openings of said first group.

5. The recuperative heat exchanger of claim 1, wherein the distance by which said flow channels of said first group extend towards said surface of said body beyond the corresponding ends of the adjacent said flow channels of said second group is at least as great as the separation between adjacent said flow channels.

6. The recuperative heat exchanger of claim 2, wherein said flow channels are defined radially inwardly thereof by a longitudinally extending, inward cover wall and are defined radially outwardly thereof by a longitudinally extending outward cover wall;

said inlet and said outlet openings for said second group of said flow channels being placed in said inward wall near the ends of said body, and said inward wall defining an annulus.

7. The recuperatuve heat exchanger of claim 6, wherein said annulus defined internally of said inward wall permits fluent material passage through the ends of said annulus.

8. The recuperative heat exchanger of claim 7, wherein said inlet and said outlet openings for said first group of said flow channels are placed in said outward wall near the ends of said body.

9. The recuperative heat exchanger of claim 7, wherein said inlet and said outlet openings for said first group of said flow channels are placed in the ends of said body between said inward and said outward cover walls.

10. The recuperative heat exchanger of any of claim 6, 8 or 9, further comprising a hollow tube in which said body is positioned; a baffle blocking said tube across the space of said annulus inside said inward wall and outside said outward wall and between said inlet and said outlet openings of all said flow channels, whereby flow of fluent material is directed through said flow channels.

11. The recuperative heat exchanger of claim 10, wherein said annulus defined internally of said inward wall permits fluid material passage through the ends of said annulus.

* * * * *